US011261688B2

(12) United States Patent
Buset et al.

(10) Patent No.: US 11,261,688 B2
(45) Date of Patent: Mar. 1, 2022

(54) ARRANGEMENT FOR PROVIDING A FLOWABLE SOLIDIFIER INTO A SUBSEA HYDROCARBON WELL

(71) Applicant: TIOS AS, Stavanger (NO)

(72) Inventors: Per Buset, Stavanger (NO); Darren Chalmers, Alford (GB)

(73) Assignee: TIOS AS, Stavanger (NO)

( * ) Notice: Subject to any disclaimer, the term of this patent is extended or adjusted under 35 U.S.C. 154(b) by 87 days.

(21) Appl. No.: 16/488,786

(22) PCT Filed: Mar. 20, 2018

(86) PCT No.: PCT/NO2018/050079

§ 371 (c)(1),
(2) Date: Aug. 26, 2019

(87) PCT Pub. No.: WO2018/182425

PCT Pub. Date: Oct. 4, 2018

(65) Prior Publication Data

US 2020/0063517 A1 Feb. 27, 2020

(30) Foreign Application Priority Data

Mar. 31, 2017 (NO) ..... 20170537

(51) Int. Cl.
*E21B 33/05* (2006.01)
*E21B 33/068* (2006.01)
(Continued)

(52) U.S. Cl.
CPC ..... *E21B 33/05* (2013.01); *E21B 33/068* (2013.01); *E21B 33/12* (2013.01); *E21B 33/134* (2013.01); *E21B 34/04* (2013.01); *E21B 41/0057* (2013.01)

(58) Field of Classification Search
CPC ..... E21B 33/05; E21B 33/068; E21B 33/12; E21B 33/134; E21B 34/04; E21B 41/0057
(Continued)

(56) References Cited

U.S. PATENT DOCUMENTS 4,823,875 A * 4/1989 Hill ..... E21B 43/263 166/280.1
4,832,128 A 5/1989 Light et al.
(Continued)

FOREIGN PATENT DOCUMENTS

EP 3130745 2/2017
GB 2239471 7/1991
(Continued)

OTHER PUBLICATIONS

International Search Report and the Written Opinion for PCT/NO2018/050079, dated Jun. 4, 2018.
Norwegian Search Report for NO 20170537, dated Oct. 31, 2017.

*Primary Examiner* — Matthew R Buck
*Assistant Examiner* — Patrick F Lambe
(74) *Attorney, Agent, or Firm* — Andrus Intellectual Property Law, LLP

(57) ABSTRACT

An arrangement is for providing a flowable solidifier into a subsea hydrocarbon well comprising a valve assembly with an opening to a well bore. The arrangement has a connection device comprising a well control unit with a lubricator device with a first through opening, an inlet connector with an inlet for the flowable solidifier to a second through opening. The arrangement further has an elongated injection tubing with a third through opening. The injection tubing is adapted to be displaced through the lubricator device to a certain position enabling the third through opening to receive the flowable solidifier from the inlet of the inlet connector and extending into the opening of the valve assembly so that one or more valves of the valve assembly are shielded from interaction with the flowable solidifier.

28 Claims, 12 Drawing Sheets

(51) Int. Cl.

| | |
|---|---|
| *E21B 33/12* | (2006.01) |
| *E21B 33/134* | (2006.01) |
| *E21B 34/04* | (2006.01) |
| *E21B 41/00* | (2006.01) |

(58) Field of Classification Search
USPC ..... 166/335
See application file for complete search history.

(56) References Cited

U.S. PATENT DOCUMENTS

| | | | | |
|---|---|---|---|---|
| 4,893,676 | A | 1/1990 | Hill | |
| 5,568,837 | A | 10/1996 | Funk | |
| 2003/0106692 | A1 | 6/2003 | Reaux | |
| 2003/0206692 | A1* | 11/2003 | Matsuoka | G02B 6/29383 385/27 |
| 2012/0090829 | A1* | 4/2012 | Bassa | E21B 23/10 166/85.5 |
| 2013/0319671 | A1 | 12/2013 | Lund et al. | |
| 2018/0148989 | A1* | 5/2018 | Ross | E21B 33/068 |

FOREIGN PATENT DOCUMENTS

| | | |
|---|---|---|
| WO | 2015194968 | 12/2015 |
| WO | 2016023037 | 2/2016 |

* cited by examiner

ARRANGEMENT FOR PROVIDING A FLOWABLE SOLIDIFIER INTO A SUBSEA HYDROCARBON WELL

CROSS-REFERENCE TO RELATED APPLICATIONS

This application is the U.S. national stage application of International Application PCT/NO2018/050079, filed Mar. 20, 2018, which international application was published on Oct. 4, 2018, as International Publication WO 2018/182425 in the English language. The International Application claims priority of Norwegian Patent Application No. 20170537, filed Mar. 31, 2017. The international application and Norwegian application are both incorporated herein by reference, in entirety.

INTRODUCTION

The present invention relates to an arrangement for providing a flowable solidifier into a subsea hydrocarbon well that is provided with a valve assembly with an opening to a well bore. The present invention also relates to a system, a method and use of an arrangement and a system for the same purpose.

PRIOR ART

A subsea hydrocarbon well comprises various components used for the operation at the wells during production and after production. In particular, after operation has been terminated, the well is to be provided with a barrier in the well bore for preventing the occurrence of a leakage of hydrocarbons to the environment thereafter. At this point, most of the components have been removed from the well and the well essentially comprises a valve assembly at the surface of the well, that is, on the surface of the seabed for a subsea hydrocarbon well. The valve assembly generally comprises valves, spools, pressure gauges and chokes for control during production of the well. The valve assembly is often denoted Christmas tree or Xmas tree, due to its shape based on the plurality of control functions.

The barrier provided to the well bore is for example a cement plug that is formed by introducing a flowable cement former through the valve assembly into the well bore of certain length to assure a sufficient closure of the well from the outside environment. A problem when providing the flowable cement former with prior art methodology is that it requires an operation using a drilling pipe or coiled tubing extending through a riser connected to an offshore platform. The use of an offshore platform for providing the barrier to the well bore is time consuming and involves significant cost for the operation.

SUMMARY OF THE INVENTION

The invention has for its object to remedy or to reduce the drawbacks of the prior art, or at least provide a useful alternative to prior art. A first object of the invention is to provide an arrangement for providing a flowable solidifier into a subsea hydrocarbon well with reduced time consumption and cost involved. A second object of the invention is to provide an arrangement for providing a flowable solidifier into a subsea hydrocarbon well without the use of a riser and an offshore platform. A third object of the invention is to provide an arrangement for providing a flowable solidifier into a subsea hydrocarbon well that can be reused for a plurality of operations.

These objects are achieved by means of an arrangement for providing a flowable solidifier into a subsea hydrocarbon well comprising a valve assembly with an opening to a well bore. The arrangement comprises a connection device comprising i) a well control unit comprising a lubricator device with a first through opening, ii) an inlet connector comprising a body attached to the well control unit, a second through opening in connection with the first through opening of the lubricator device, and an inlet for the flowable solidifier to the second through opening, wherein the connection device is adapted to be connected to the valve assembly so that the secand opening of the inlet connector is in connection with the opening of the valve assembly to the well bore of the well, wherein the arrangement further comprises:

an elongated injection tubing comprising a third through opening, which injection tubing is adapted to be displaced through the lubricator device to a certain position enabling the third through opening to receive the flowable solidifier from the inlet of the inlet connector and extending into the opening of the valve assembly so that one or more valves of the valve assembly are shielded from interaction with the flowable solidifier.

The arrangement comprising the connection device and the injection tubing enables employment of the arrangement from the surface of the sea using a vessel provided with lifting means. The connection device comprising the control unit and the inlet connector is brought to the valve assembly and is connected to the valve assembly by means of the inlet connector. The injection tubing is thereafter displaced through the lubricator device to the certain position. In the certain position, the third through opening of injection tubing receives the flowable solidifier from the inlet of the inlet connector and guides the flowable solidifier into the well bore while shielding one or more valves of the valve assembly from interaction with the flowable solidifier. Preferably, also other components of the valve assembly are shielded from interaction with the flowable solidifier. Furthermore, at least a part of the opening of the valve assembly to the well bore is shielded by the injection tubing.

By means of the arrangement, the flowable solidifier is allowed to be provided into a well that is pressurized or none pressurized without the use of a riser and an offshore platform. After employment of the arrangement, the injection tubing and the connection device are removed from the valve assembly and may be employed to another hydrocarbon well that is to be provided with a barrier in corresponding manner.

The term "valve assembly" relates to a control device comprising one or more valves for control of the well. The valve assembly is in particular a device denoted Christmas tree or Xmas tree in the field of subsea hydrocarbon wells.

The term "flowable solidifier" relates to a flowable medium that is to be provided into the well bore where it is solidifying to form a barrier to an outside environment. It shall be understood that various of flowable solidifier may be used for forming the barrier, such as a cement former, a geopolymer former, various polymeric configuration, etcetera.

The term "lubricator device" relates to device for allowing a pressurized pass-through of tools into a well. Lubricators are for example used in the field of hydrocarbon wells for passage of drilling pipes, coiled tubing and wireline into a well bore of a well.

According to an embodiment of the invention, the elongated injection tubing has a length that enables it, when arranged in said certain position, to extend into the opening of the valve assembly passing said one or more valves and an opening to the well bore. The injection tubing is configured with a sufficient length for extending over passages to the valves and other components of the valve assembly that is to be shielded from interaction with the flowable solidifier.

According to an embodiment of the invention, the elongated injection tubing has a length equal to or exceeding a length of the opening of the valve assembly to the well bore. Preferable, the injection tubing is configured with a length that is sufficient to extend the full length through the opening of the valve assembly into the well bore of the well. Thereby, it is assured that the valve assembly is fully shielded from interaction with the flowable solidifier.

According to an embodiment of the invention, the connection device further comprises an attachment device for providing a releasable attachment of the connection device to the valve assembly of the well so that the second opening of the inlet connector is firmly connected to the opening of the valve assembly. Preferably, the attachment device comprises an engagement member comprising an engaged state and a disengaged state, and an attachment mechanism for changing the engagement member between the engaged state and the disengaged state. The engagement member is adapted to engage with the valve assembly. The attachment mechanism comprises for example a hydraulic induced drive unit, a pneumatic induced drive unit, an electric induced drive unit, and etcetera.

According to an embodiment of the invention, the injection tubing comprises a primary stop member and the inlet connector comprises a secondary stop member, and wherein the injection tubing is adapted to be displaced to a position in which the primary stop member and secondary stop member engage with each other in the certain position.

According to an embodiment of the invention, the injection tubing comprises a necking connecting the third through opening in all orientations when the injection tubing is positioned in the certain position. The necking is arranged surrounding a longitudinal axis of the injection tubing. Thereby, the injection tubing is configured to receive the flowable solidifier regardless of orientation when the injection tubing is in the certain position. According to an embodiment of the invention, the arrangement comprises a further attachment device adapted to provide a releasable attachment of the injection tubing to the inlet connector so that the injection tubing is firmly attached in said certain position. Preferably, the further attachment device comprises a further engagement member comprising an engaged state and a disengaged state, and a further attachment mechanism for changing the further engagement member between the engaged state and the disengaged state. The further engagement member is adapted to engage with the inlet connector. The further attachment mechanism comprises for example a hydraulic induced drive unit, a pneumatic induced drive unit, an electric induced drive unit, and etcetera.

According to an embodiment of the invention, the well control unit comprises a lubricator valve assembly comprising a lubricator valve device adapted to be controlled so that the pressure of the first through opening of the lubricator device and second through opening of the inlet connector are adjusted to equilibrium with the pressure of the opening of the valve assembly to the well bore of the well. Preferably, the lubricator valve assembly comprises at least two separately controlled lubricator valve devices for purpose of redundancy.

After the pressure of the first through opining and second through opening has been adjusted, a valve of the valve assembly the well bore is opened, which allows a portion of the injection tubing to pass the valve of the valve assembly and thereby shield the valve from interaction with the flowable solidifier. By adjusting the pressure of the first through opining and second through opening to equilibrium with or essentially equilibrium with the pressure of the opening of the valve assembly, allows the injection tubing to be securely displaced through the lubricator device to the certain position in which enables it to receive the flowable solidifier.

According to an embodiment of the invention, the arrangement comprises attachment means for wireline connection to the connection device. By configuring the connection device for displacement to the valve assembly using a wireline operation enables the operation of providing the flowable solidifier to the well bore to be performed in a reliable and cost effective manner.

According to an embodiment of the invention, the arrangement comprises further attachment means for wireline connection to the injection tubing. By configuring the injection tubing for displacement through the lubricator device to the certain position using a wireline operation enables the operation of providing the flowable solidifier to the well bore to be performed in a reliable and cost effective manner.

According to an embodiment of the invention, the connection device further comprises an outlet for discharge of a fluid from the well opening. The outlet from the connection device enables a fluid to be removed from the well, such prior to the introduction of the flowable solidifier for the purpose of assuring that the flowable solidifier forms a barrier of sufficient quality.

According to an embodiment of the invention, the outlet of the inlet connector comprises an outlet valve assembly comprising an outlet valve device for controlling the outlet of a fluid from the well bore. Preferably, the outlet valve assembly comprises at least two separately controlled outlet valve devices for purpose of redundancy.

According to an embodiment of the invention, the inlet of the inlet connector comprises an inlet valve assembly comprising an inlet valve device for controlling the introduction of the flowable solidifier to the well bore of the well. Preferably, the inlet valve assembly comprises at least two separately controlled inlet valve devices for purpose of redundancy.

According to an embodiment of the invention, the arrangement further comprises a seal arrangement adapted to form a sealing between the inlet connector and the injection tubing when the injection tubing is in said certain position. The seal arrangement is adapted to be arranged between the body of the inlet connector and the injection tubing. The seal arrangement is configured of a material that enables forming the sealing at elevated pressure and temperature of the well bore.

According to an embodiment of the invention, the inlet connector comprises a connection means for supply of the flowable solidifier to the inlet. The connection means is configured to connect a supply conduit, such as a hose, to the inlet for receipt of the flowable solidifier from a vessel at the surface of the sea.

According to an embodiment of the invention, the inlet connector comprises a connection means for discharge of the fluid from the outlet. The connection means is configured to connect a discharge conduit, such as a hose, to the outlet for discharge of the fluid to a vessel at the surface of the sea.

According to an embodiment of the invention, the arrangement further comprises a first separation device and a second separation device adapted to be introduced into the well through the inlet of the inlet connector and having the flowable solidifier between them. The first separation device and a second separation are adapted to define a section with reduced presences of contaminating medium that adversely influence the quality of the barrier to be formed by the flowable solidifier.

According to an embodiment of the invention, the first separation device comprises a first separation plug and a first displacement element adapted to engage with the first separation plug, and wherein the second separation device comprises a second separation plug and a second displacement element adapted to engage with the second separation plug.

According to an embodiment of the invention, the first separation plug and second separation plug are positioned at an end portion of the injection tubing in connection with the third through opening, and wherein the inlet of the inlet connector and the third through opening of the injection tubing are configured dimensioned for allowing a passage of the first displacement element and the second displacement element.

The first separation plug and the second separation plug are arranged at an end portion of the injection tubing. The first displacement element is adapted to be introduced into the well bore through the inlet and the third through opening and engage with the first separation plug. The first displacement element has the function of initiating the displacement of the first separation plug into the well bore. The first separation plug is for example an elastic plug comprising one or more flanges adapted to bear against the walls of the well bore. Correspondingly, the second displacement element is adapted to be introduced into the well bore through the inlet and the third through opening and engage with the second separation plug. The second displacement element has the function of initiating the displacement of the second separation plug into the well bore.

The first separation plug and the second separation plug are configured to provide engagement with the respective first displacement element and second displacement element. For example, the first displacement element and second displacement element are sphere with different size. The second separation plug allows passage of the first displacement element whereas the first separation plug is adapted to enable engagement with the first displacement element. The second separation plug is adapted to enable engagement with the second displacement element.

Preferably, before introducing the first separation plug and the first displacement element into the well bore, a separation fluid is introduced into the well bore. The separation fluid has the function to clear the well bore from impurities enabling the flowable solidifier to form a barrier of sufficient quality. Correspondingly, preferably, after introducing the first separation plug and the second displacement element into the well bore, a separation fluid is introduced into the well bore.

According to an embodiment of the invention, the arrangement comprises control means for control of valve device of the well control unit and a valve of the valve assembly.

According to an embodiment of the invention, the arrangement comprises control means for controlling a releasable attachment of the connection device to the valve assembly by means of the attachment device.

According to an embodiment of the invention, the arrangement comprises control means for controlling a releasable attachment of the injection tubing to the inlet connector by means of the further attachment device.

According to an embodiment of the invention, the arrangement comprises control means for controllable grip and release of a wireline to the connection device. According to an embodiment of the invention, the arrangement comprises control means for controllable grip and release of a wire-line to the injection tubing.

According to an embodiment of the invention, the arrangement further comprises a supply conduit for feeding the flowable solidifier to the inlet of the inlet connector. The supply conduit is adapted to be connected to a vessel comprising means for producing and/or storing the flowable solidifier. The supply conduit is for example a hose extending from a vessel at the surface of the sea to the inlet.

According to an embodiment of the invention, the arrangement further comprises a discharge conduit adapted to receive a fluid from the outlet of the inlet connector. By means of the discharge conduit impurities in the well bore of the well can be removed in order to prevent an adverse influence on the barrier formed from the flowable solidifier. The discharge conduit is for example a hose extending from the outlet to a vessel at the surface of the sea to the inlet.

According to an embodiment of the invention, the inlet of the inlet connector and the third through opening of the injection tubing are configured for a passage of the flowable solidifier, which flowable solidifier comprises a flowable configuration comprising cement adapted to solidify and form a concrete barrier in the well bore of the well.

The invention further relates to a system for providing a flowable solidifier into a subsea well. The system comprises an arrangement according to any of above described embodiments and a lifting arrangement for lifting the well control unit and the injection tubing to the valve assembly of the well.

According to an embodiment of the invention, the system further comprises means for producing and/or storing the flowable solidifier.

According to an embodiment of the invention, the system comprises a vessel comprising the lifting arrangement and the means for producing and/or storing the flowable solidifier.

The invention further relates to a method for providing a flowable solidifier into a subsea well by means of an arrangement according to any of above described embodiments. The method comprises:

- displacing the connection device to engagement with the valve assembly of the well so that the second opening of the inlet connector is brought in connection with the opening of the valve assembly,
- displacing the injection tubing through the lubricator device to a certain position enabling the third through opening of the injection tubing to receive the flowable solidifier from the inlet of the inlet connector and so that the injection tubing extends into the opening of the valve assembly passing one or more valves of the valve assembly, and
- providing the flowable solidifier through the inlet of the inlet connector and the third through opening, and into the well bore of the well.

According to an embodiment of the invention, the method further comprises terminating providing the flowable solidifier to the through the inlet of the inlet connector after a sufficient amount of the flowable solidifier has been provided into the well bore of the well;

displacing the connection device away from the valve assembly and the connection device, and displacing the connection device away from the valve assembly.

According to an embodiment of the invention, the method further comprises attaching the connection device to the valve assembly by means of changing the attachment device from a disengaged state to an engaged state.

According to an embodiment of the invention, the method further comprises arranging the injection tubing to said certain position by displacing the injection tubing so that the primary stop member of the injection tubing engages with the secondary stop member of the inlet connector.

According to an embodiment of the invention, the method further comprises attaching the injection tubing to the inlet connector by means of changing the further attachment device from a disengaged state to an engaged state.

According to an embodiment of the invention, the method further comprises before displacing the injection tubing through the lubricator device, adjusting the pressure of the first through opening of the lubricator device and second through opening of the inlet connector so that the pressure is adjusted to equilibrium with the pressure of the opening of the valve assembly to the well bore of the well, and opening a valve of the valve assembly so that an open connection is established between the opening of the valve assembly and the first through opening and the second through opening.

According to an embodiment of the invention, the method further comprises before displacing the connection device away from the valve assembly, closing a valve of the valve assembly so that the opening into the well bore of the well is closed.

According to an embodiment of the invention, the method further comprises after closing the valve of the valve assembly, displacing the injection tubing out from the connection device through the lubricator device, and displacing the connection device away from the valve assembly.

According to an embodiment of the invention, the method further comprises before displacing the injection tubing out from the connection device, detaching the injection tubing from the inlet connector by means of changing the further attachment device from an engaged state to a disengaged state.

According to an embodiment of the invention, the method further comprises before displacing the connection device away from the valve assembly, detaching the connection device from the valve assembly by means of changing the attachment device from an engaged state to a disengaged state.

According to an embodiment of the invention, the step of providing the flowable solidifier further comprises the steps of the step of providing the flowable solidifier further comprises the steps of a) providing a separation fluid through the inlet of the inlet connector and the third through opening into the well bore of the well, b) providing the first separation device into the well bore of the well, c) providing a flowable solidifier through the inlet of the inlet connector and the third through opening into the well bore of the well, d) providing the second separation device into the well bore of the well, and e) providing a separation fluid through the inlet of the inlet connector and the third through opening into the well bore of the well.

The invention further relates to the use of an arrangement and use of a system according to any of above described embodiments.

BRIEF DESCRIPTION OF DRAWINGS

In the following is described examples of preferred embodiments illustrated in the accompanying drawings, wherein.

DETAILED DESCRIPTION OF THE INVENTION

Figure 1:
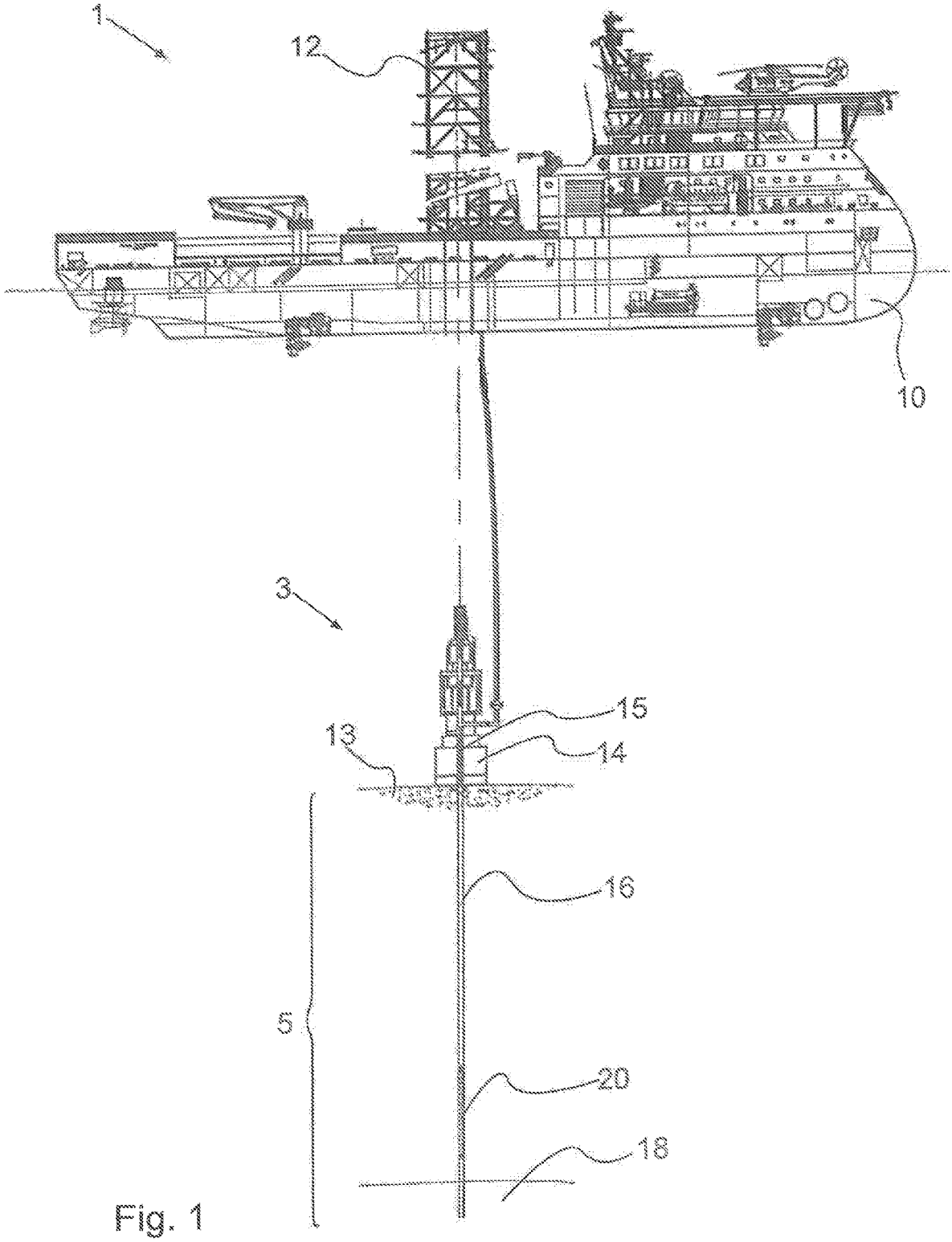
FIG. 1 discloses a schematic view of the a system comprising an arrangement for providing a flowable solidifier into a subsea hydrocarbon well.

In FIG. 1 a schematic view of a system 1 and an arrangement 3 for providing a flowable solidifier into a subsea hydrocarbon well 5 is disclosed. The system 1 comprises the arrangement 3 and vessel 10 comprising a lifting arrangement 12 for displacing the arrangement 3 by means of wireline to a valve assemble 14 at the well 5. The system 1 further comprises means for producing and/or storing the flowable solidifier.

The valve assembly 14 comprises an opening 15 to a well bore 16 of the well 5. In the illustration in FIG. 1, the well bore 16 is extending into a reservoir 18 of the well 5. The valve assembly 14 is in particular a so called Christmas tree or Xmas tree and comprises one or more valves for control of the well 5. The valve assembly 14 is arranged at the surface of the well 5, which is located at the surface of the seabed 13.

In FIG. 1, the arrangement 3 has been displace from the vessel 10 down to the valve assembly 14 and a connection to the valve assembly 14 has been established. A flowable solidifier has been provided into the well bore 16 by means of the arrangement 3 according to the invention and the flowable solidifier has formed a barrier 20 in the well bore 16 of the well 5. The barrier 20 has been arranged in the well bore 16 with a distance separating it from the valve assembly 14.

The arrangement 3 will be explained in further detail with reference to FIGS. 2, 3 and 4*a-e*.

Figure 2A:
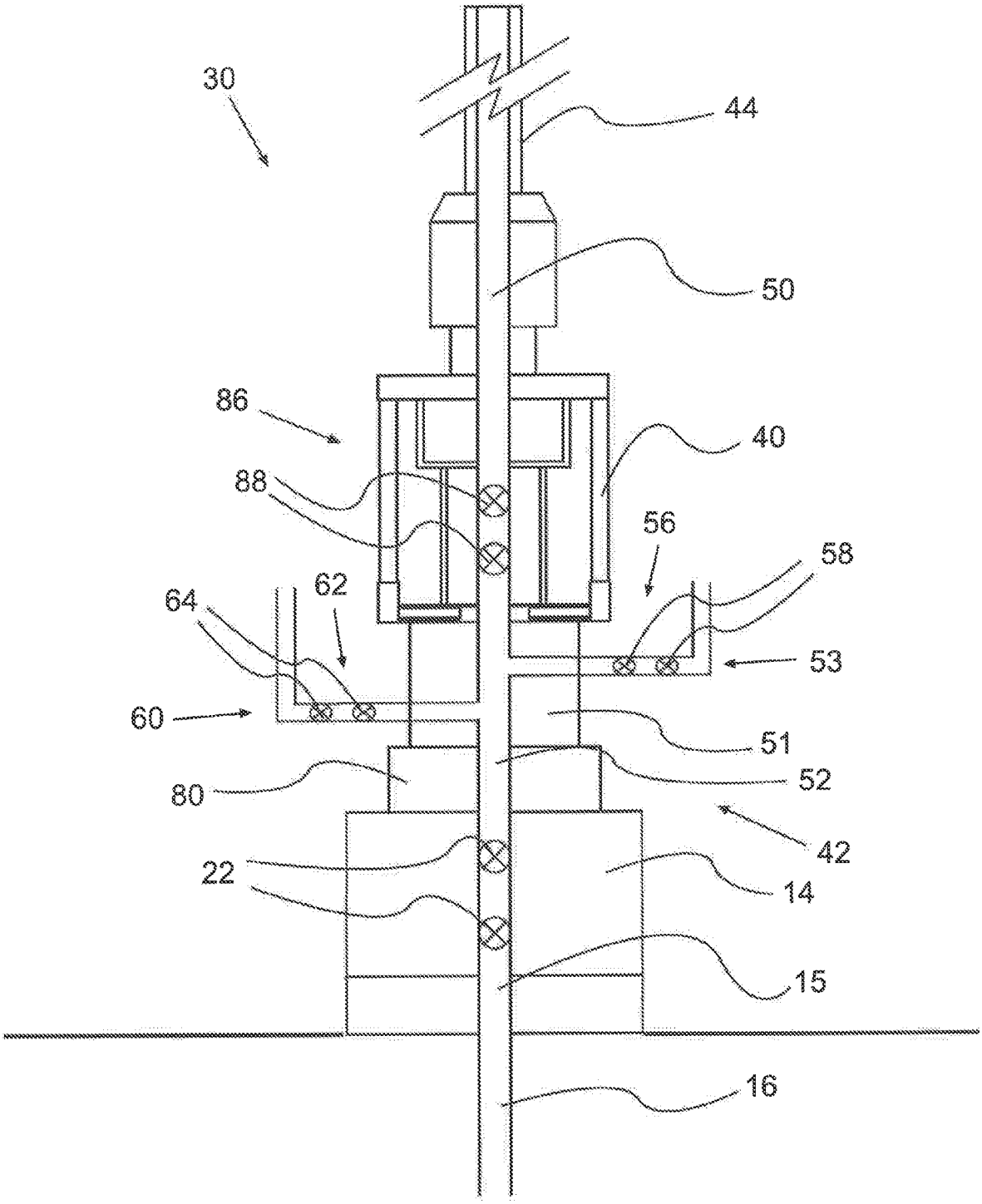
FIG. 2*a* discloses the arrangement in FIG. 1 in further details connected to a valve assembly with an opening to a well bore of the well.
Figure 2B:
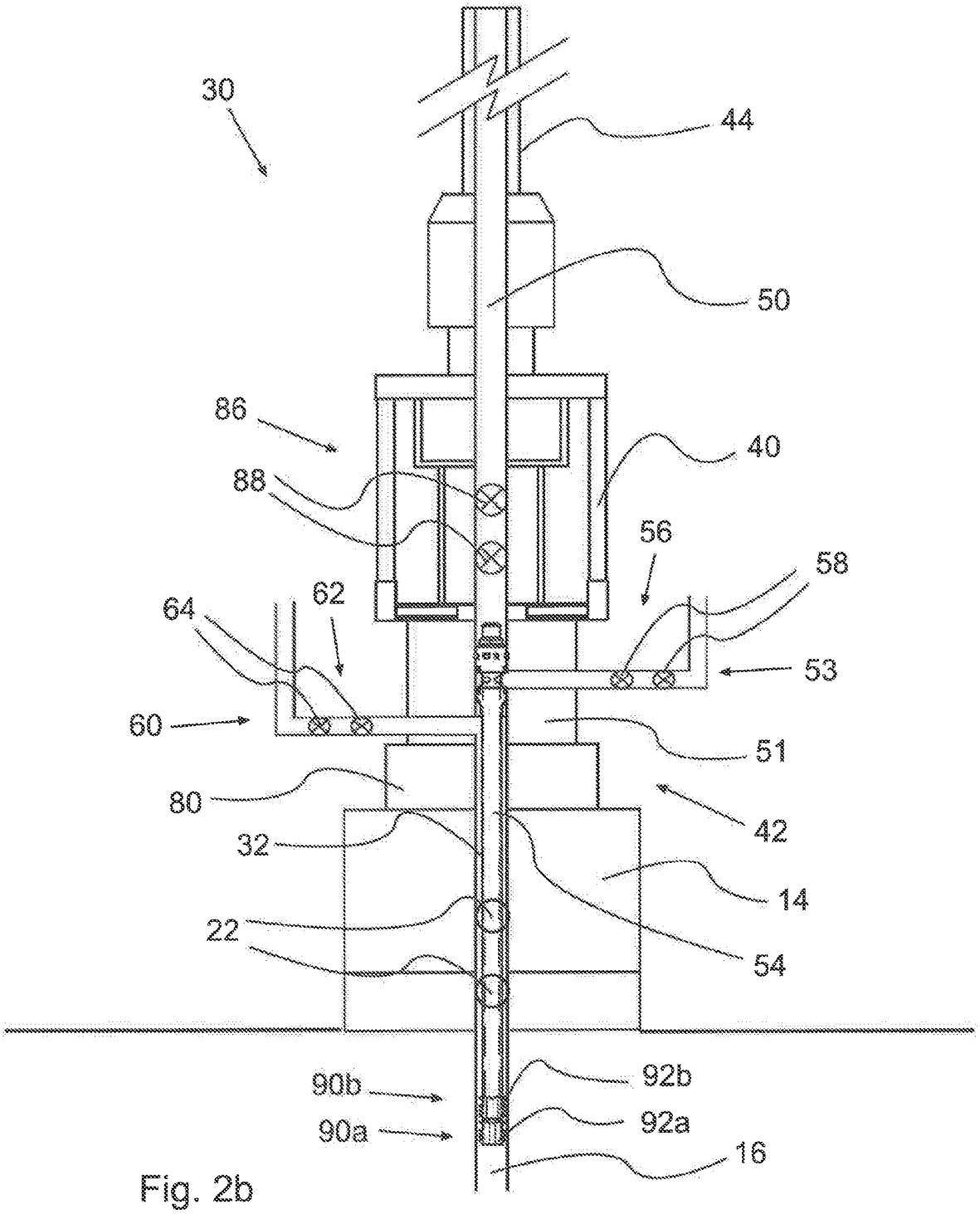
FIG. 2*b* discloses the arrangement in FIG. 1 in further details where an elongated injection tubing of the arrangement has been brought to the valve assembly.
Figure 3:
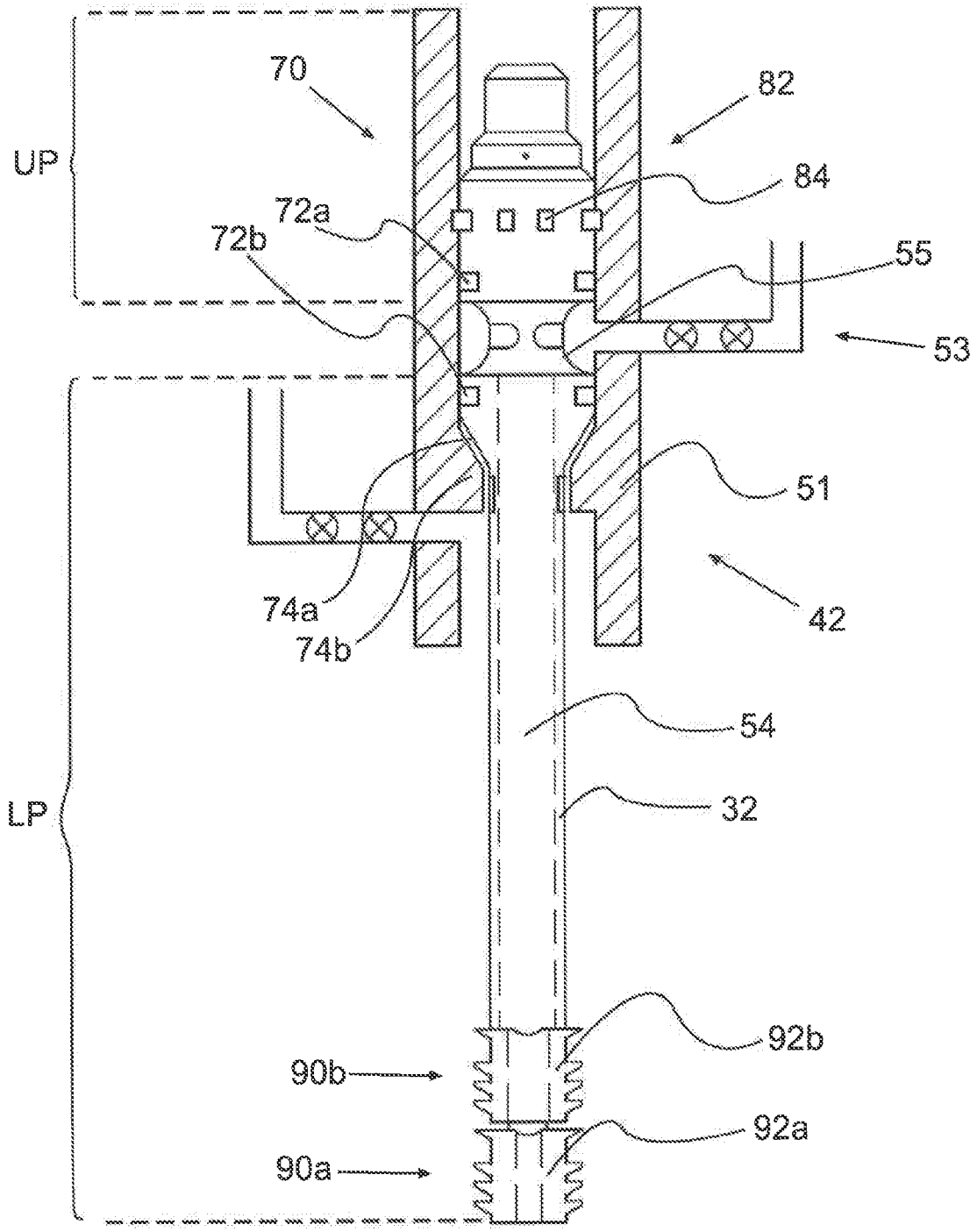
FIG. 3 discloses an inlet connector and the injection tubing of the arrangement in FIG. 1 in further details.

In FIGS. 2*a*, 2*b* and 3 the arrangement 3 in FIG. 1 is disclosed in further details in connection to the valve assembly 14 of the well 5.

The valve assembly 14 comprises a valve 22 at the opening 15 to the well bore 16 for opening and closing the access to the well bore 16. The opening 15 relates to a main opening into the well bore 16 of the well 5. That is, an opening used when establishing the well bore 16 by means of a drilling operation.

The arrangement 3 comprises a connection device 30 and an injection tubing 32. In FIG. 2*a* only the connection device 30 has been arranged at the valve assembly 14. In FIG. 2*b*, both the connection device 30 and the injection tubing 32 has been arranged at the valve assembly 14.

The connection device 30 and the injection tubing 32 are separate devices. The connection device 30 is adapted to be displaced from the vessel 10 down to the valve assembly 14 of the well 5 and be connected to the valve assembly 14. Thereafter, the injection tubing 32 is adapted to be displaced from the vessel 10 into the connection device 30, as will be explained in further details in the following.

The arrangement 3 comprises attachment means for wireline connection to the connection device 30. Correspondingly, the arrangement 3 comprises further attachment means for wireline connection to the injection tubing 32. The attachment means and further attachment means are not explicitly disclosed in the figures. In FIG. 1 two guidewires are seen. The guidewires are used for the deployment and recovery of subsea equipment, and for running wireline to act as a guide.

The connection device 30 comprises a well control unit 40 and an inlet connector 42. The well control unit 40 comprises a lubricator device 44 with a first through opening 50. The inlet connector 42 comprises a body 51 attached to the well control unit 40, a second through opening 52 in connection with the first through opening 50 of the lubricator device 44. The first through opening 50 and the second through opening 52 form a combined opening configured to receive the injection tubing 32.

The inlet connector 42 further comprises an inlet 53 extending from an outside of the body 51 to the second through opening 52. The inlet 53 is adapted to conduct the flowable solidifier to the second through opening 52. The inlet connector 42 further comprises connection means for supply of the flowable solidifier to the inlet 53. The connection means is configured to connect a supply conduit, such as a hose, to the inlet 53 for receipt of the flowable solidifier from the vessel 10 at the surface of the sea.

The injection tubing 32 comprises a third through opening 54. The injection tubing 32 is adapted to be displaced through the first through opening 50 and into the second through opening 52 to a certain position enabling the third through opening 54 to receive the flowable solidifier from the inlet of the inlet connector 42. The injection tubing 32 comprises a necking 55 connecting the third through opening 54 in all orientations when the injection tubing 32 is positioned in the certain position. The necking 55 is arranged surrounding a longitudinal axis of the injection tubing 32. Thereby, the injection tubing 32 is configured to receive the flowable solidifier regardless of orientation when the injection tubing 32 is in the certain position.

The injection tubing 32 is further adapted, in the certain position, to extend through the opening 15 of the valve assembly 14 so that one or more valves of the valve assembly 14 are shielded from interaction with the flowable solidifier.

The inlet connector 42 comprises an inlet valve assembly 56 at the inlet 53. The inlet valve assembly 56 comprising an inlet valve device 58 for controlling the introduction of the flowable solidifier to the well bore 16 of the well 5. In the disclosed embodiment, the inlet valve assembly 56 comprises two separately controlled inlet valve devices 58 for purpose of redundancy of the control of the introduction of the flowable solidifier into the well bore 16.

The inlet connector 42 further comprises an outlet 60 extending from the second through opening 52 to the outside of the body 51. The outlet 60 is adapted to conduct a fluid out of the well bore 16 of the well 5. The inlet connector 42 comprises connection means for discharge of the fluid from the outlet 60. The connection means is configured to connect a discharge conduit, such as a hose, to the outlet 60 for discharge of the fluid to the vessel 10 at the surface of the sea. It shall be understood that the outlet 60 is not necessary for the introduction of the flowable solidifier into the well bore of the well.

The inlet connector 42 further comprises an outlet valve assembly 62. The outlet valve assembly 62 comprising an outlet valve device 64 for controlling the outlet of a fluid from the well bore 16. In the disclosed embodiment the outlet valve assembly 62 comprises two separately controlled outlet valve devices 64 for purpose of redundancy control of the outlet 60.

The arrangement 3 further comprises a seal arrangement 70 adapted to form a sealing between the body 51 of the inlet connector 42 and the injection tubing 32 when the injection tubing 32 is in said certain position, see FIG. 3. Thereby, it is assured that there is no leakage of the flowable solidifier into the opening 15 of the valve assembly 14 and into the well control unit 40 well control unit 40. In the disclosed embodiment, the sealing arrangement 70 comprises a first sealing device 72*a* and a second sealing device 72*b* arranged on opposite part of body 51 of the inlet connector 42 in respect to the inlet 53. The first sealing device 72*a* and a second sealing device 72*b* are adapted to bear between the body 51 of the inlet connector 42 and an upper portion (UP) and lower portion (LP) of the injection tubing 32.

The arrangement 3 further comprises a primary stop member 74*a* at the injection tubing 32 and the inlet connector 42 comprises a secondary stop member 74*b* adapted to engage with each other for arranging the injection tubing 32 in the certain position. The secondary stop member 74*b* is for example a protrusion directed into the second through opening 52. The primary stop member 74*b* is for example a protrusion directed in the opposite direction to the secondary stop member 74*b* when the injection tubing 32 is displaced through the first through opening 50 and into the second through opening 52, see FIG. 3.

The connection device 30 further comprises an attachment device 80 for providing a releasable attachment of the connection device 30 to the valve assembly 14 of the well 5 so that the second opening 52 of the inlet connector 42 is firmly connected to the opening 15 of the valve assembly 14. In the discloses embodiment, the attachment device 80 is schematic illustrated at the inlet connector 42. However, it shall be understood that the attachment device 80 may be arranged at the well control unit 40 or between both the well control unit 40 and inlet connector 42, see FIGS. 2*a* and 2*b*.

The attachment device 80 comprises an attachment mechanism for changing the attachment device 80 between an engaged state and a disengaged state. The attachment mechanism 80 comprises for example a hydraulic induced drive unit, a pneumatic induced drive unit, an electric induced drive unit, and etcetera.

The arrangement 3 further comprises a further attachment device 82 that is adapted to provide a releasable attachment of the injection tubing 32 to the inlet connector 42 when the injection tubing 32 has been displaced to the certain position. Thereby, it is assured that the injection tubing 32 is firmly held in the certain position during providing the flowable solidifier into the well bore 16 of the well 5. The further attachment device 82 comprises preferably a movable engagement member 84 that is adapted to engage with the inlet connector 42. In the disclosed embodiment, the further attachment device 82 comprises a plurality of movable engagement members 84 that are adapted to engage with respective recesses in an inner wall section of the body 51 of the inlet connector 42.

The further attachment device 82 comprises a further attachment mechanism for changing the one or more engagement members 84 between an engaged state and a disengaged state. The further attachment mechanism comprises for example a hydraulic induced drive unit, a pneumatic induced drive unit, an electric induced drive unit, and etcetera.

The well control unit 40 comprises a lubricator valve assembly 86 comprising a lubricator valve device 88 adapted to be controlled so that the pressure of the first through opening 50 of the lubricator device 44 and second through opening 52 of the inlet connector 42 are adjusted to equilibrium with the pressure of the opening 15 of the valve assembly 14 to the well bore 16 of the well 5. In the disclosed embodiment, the lubricator valve assembly 86 comprises two separately controlled lubricator valve devices 88. Thereby, a redundant control of the pressure of the first through opening 50 and second through opening 52. However, it shall be understood that a single lubricator valve device 88 is sufficient for the function of the pressure control.

After the pressure of the first through opening 50 and second through opening 52 has been adjusted to equilibrium with or essentially equilibrium with the pressure of the opening 15 of the valve assembly 14, the valve 22 of the valve assembly 14 at the opening 15 to a well bore 16 is opened. Thereby, the first through opening 50, the second through opening 52 and the opening 22 of the valve assembly 14 are in communication with each other, and the injection tubing 32 is thereafter adapted to be displaced through first through opening 50 of the lubricator device 44 into the second through opening 52 of the inlet connector 42. The injection tubing 32 is adapted to be displaced to the certain position which enables it to receive the flowable solidifier from the inlet 53 of the inlet connector 42 and passing one or more valves 22 of the valve assembly 14. Preferably, the injection tubing 32 is configured with a length that allows it to pass through the full length of the opening 22 of the valve assembly 14 into the well bore 16 of the well 5. Thereby, it is assured that the flowable solidifier can be conducted into the well bore 16 without interaction with one or more valves 22 and other control functions of the valve assembly 14.

The arrangement 3 further comprises a first separation device 90*a* and a second separation device 90*b* adapted to be introduced into the well bore 16 and having the flowable solidifier between them. The first separation device 90*a* comprises a first separation plug 92*a* and a first displacement element 94*a* adapted to engage with the first separation plug 90*a*. Correspondingly, the second separation device 90*b* comprises a second separation plug 92*b* and a second displacement element 94*b* adapted to engage with the second separation plug 90*b*. The first separation plug 90*a* and the second separation plug 90*b* are positioned at an end portion of the injection tubing 32 that is adapted to be directed towards the well bore 16 of the well 5.

The first separation plug 90*a* and the second separation plug 90*b* are in connection with the third through opening 54 of the injection tubing 32 and are adapted to adapted to be controllable displaced into the well bore 16 of the well 5 by means of the introduction of the first displacement element 94*a* and the second displacement element 94*b* so that the flowable solidifier is arranged between them.

The first separation plug 92*a* and the second separation plug 92*b* comprise one of more fins that are adapted to bear against the wall of the well bore 16 so that the risk of interaction between impurities in the well bore 16 and the flowable solidifier is reduced. Thereby, the quality of the formed barrier 20 from the flowable solidifier is assured.

Preferably, prior to displacing the first separation plug 92*a* into the well bore 16, a separation fluid is introduced in to the well bore 16. Preferably, subsequently to the displacing the second separation plug 92*b* into the well bore 16, a separation fluid is correspondingly introduced into the well bore 16. By means of the separation fluid, the quality of the barrier 20 formed from the flowable solidifier can further be assured.

The operation of the arrangement and the system in FIG. 1 will further be explained with reference to FIG. 4*a-e* and flow chart in FIGS. 5 and 6.

Figures 4A, 5:
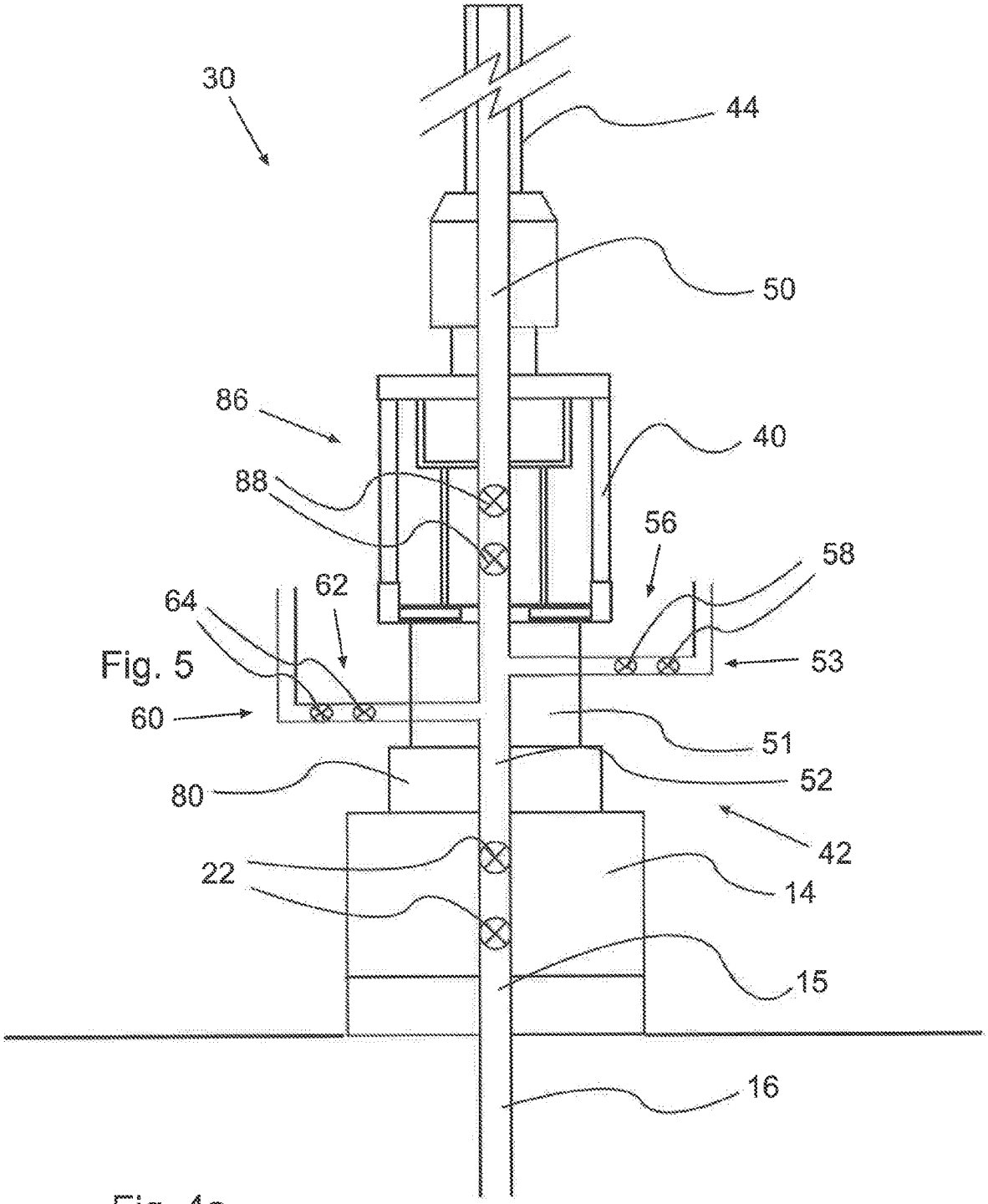
FIG. 4*a-e* discloses illustrations of steps in the process of providing a flowable solidifier into a subsea hydrocarbon well by means of the arrangement in FIG. 1.
FIG. 5 discloses a flow chart of a method for providing a flowable solidifier into a subsea hydrocarbon well according to an embodiment of the invention.

In FIG. 5 flow chart of a method for providing a flowable solidifier into a subsea hydrocarbon well 5 according to an embodiment of the invention is disclosed.

The method comprises, in a step 110, displacing the connection device 30 to engagement with the valve assembly 14 of the well 5 so that the second through opening 52 of the inlet connector 42 is brought in connection with the opening of the valve assembly 14. In case the valve assembly 14 is provided with a cover, this is removed prior to the operation of connecting the connection device 30 to the valve assembly 14.

FIG. 4*a* discloses a state in which the connection device 30 has been displaced to contact with the valve assembly 14. The first through opening 50 and second through opening 52 are arranged in alignment with the opening 15 of the valve assembly 14 to the well bore 16 of the well 5. The lubricator valve devices 88 of the well control unit 40 are closed. That is, valves 88 of the first through opening 50 are closed. Furthermore, valves of the inlet 53 and the outlet 60 of the inlet connector 42 are closed. Also, the valve 22 of the valve assembly 14 is closed. See FIG. 4*a*.

The method comprises, in a step 120, displacing the injection tubing 32 through the lubricator device 44 to a certain position enabling the third through opening 54 of the injection tubing 32 to receive the flowable solidifier from the inlet 53 of the inlet connector 42 and so that the injection tubing 32 extends into the opening 15 of the valve assembly 14 passing one or more valves of the valve assembly.

Figure 4B:
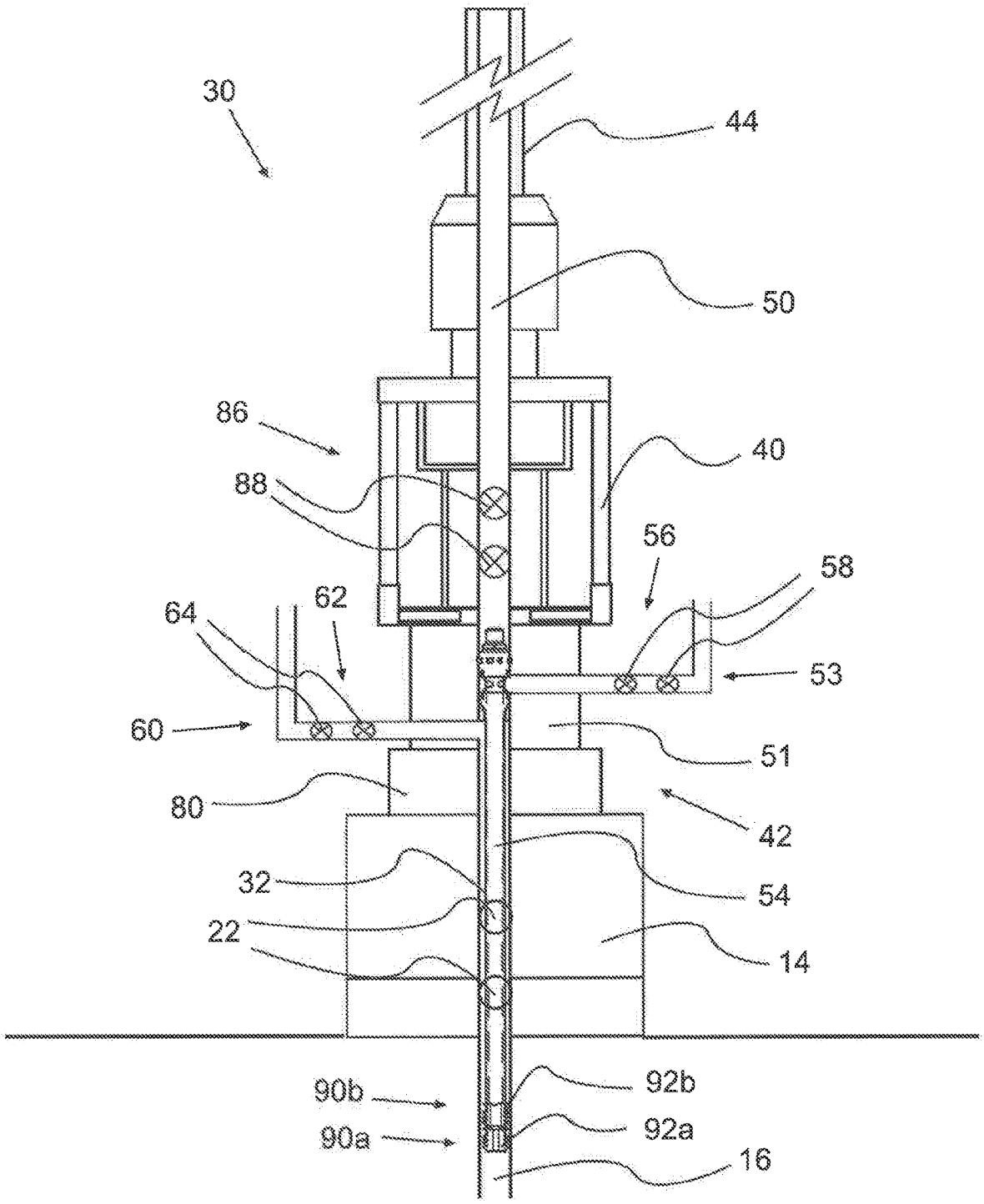

FIG. 4*b* discloses a state where the injection tubing 32 has been positioned in the certain position. As can be seen, the third through opening 54 of the injection tubing 32 is positioned so that it enables receipt of the flowable solidifier from the inlet 53 of the inlet connector 42. In the state disclosed in FIG. 4*b*, the valves 58, 64, 88 of the connection device 30 are closed. That is, valves of the well control unit 40 are closed, valves of the inlet 53 and the outlet 60 of the inlet connector 42 are closed. However, the valve 15 of the valve assembly 14 is open and the injection tubing 32 is extending through the opening 15 of the valve assembly 14 down into the well bore 16 of the well 5. In that the valves 58 of the inlet 53 are closed, the flowable solidifier is currently not being provided into the well bore 16. Likewise, in that the valves 64 of the outlet 60 are closed, no fluid is being discharged from the well bore 16.

The method comprises, in a step 130, providing the flowable solidifier through the inlet 53 of the inlet connector 42 and the third through opening 54 and into the well bore 16 of the well 5.

Figure 4C:
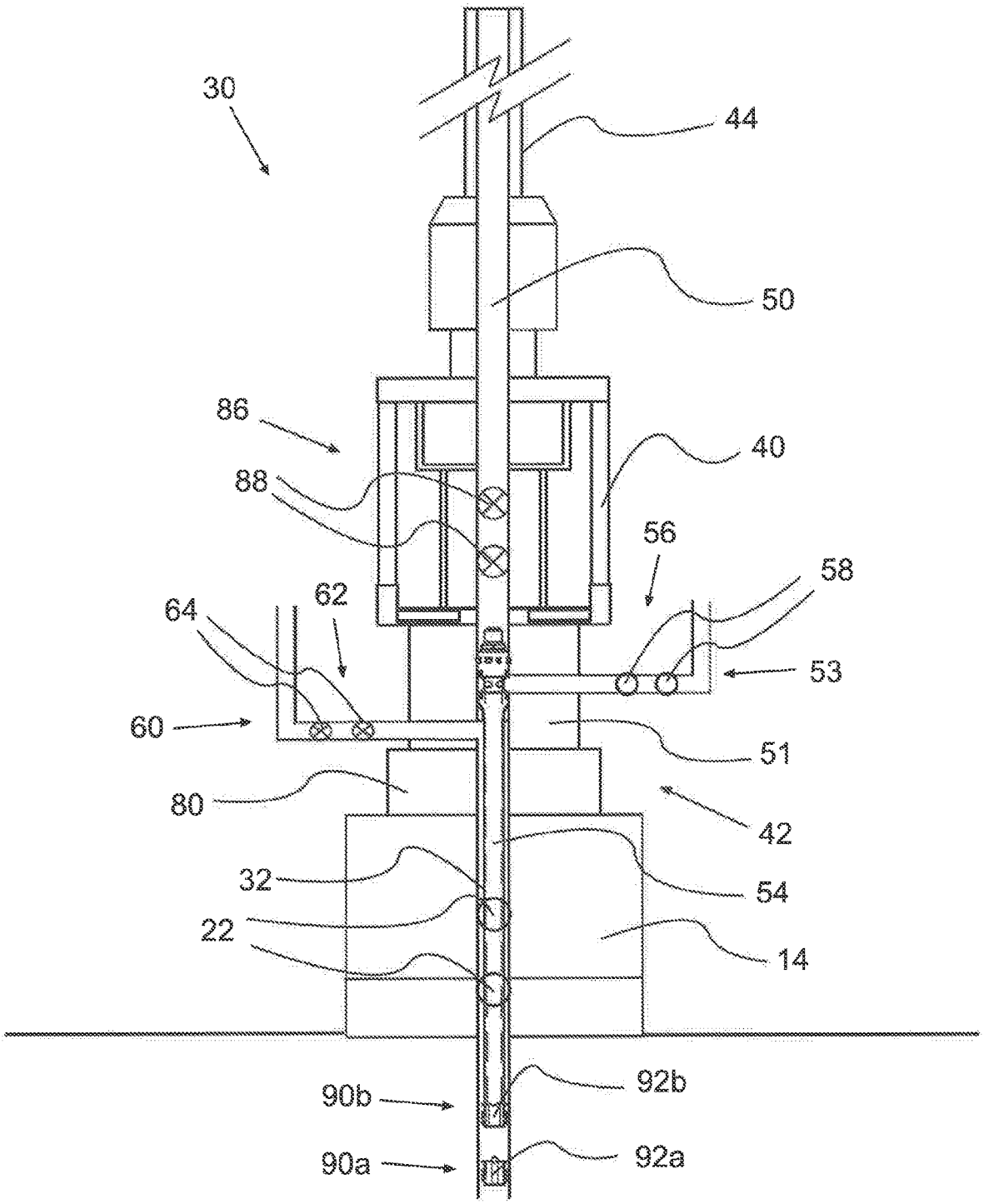

FIG. 4*c* discloses a state where the valves 58 at the inlet 53 of the inlet connector 42 have been opened and the flowable solidifier is being provided into the well bore 16 of the well 5. The valves 64 of the outlet 60 of the inlet connector 42 are remaining in a closed state. Likewise, the valves 88 of the well control unit 40 remains in a closed state.

The method comprises, in a step 140, terminating providing the flowable solidifier through the inlet 53 of the inlet connector 42. In a step 150, the method comprises displacing the injection tubing 32 away from the valve assembly 14 and the connection device 30.

Figure 4D:
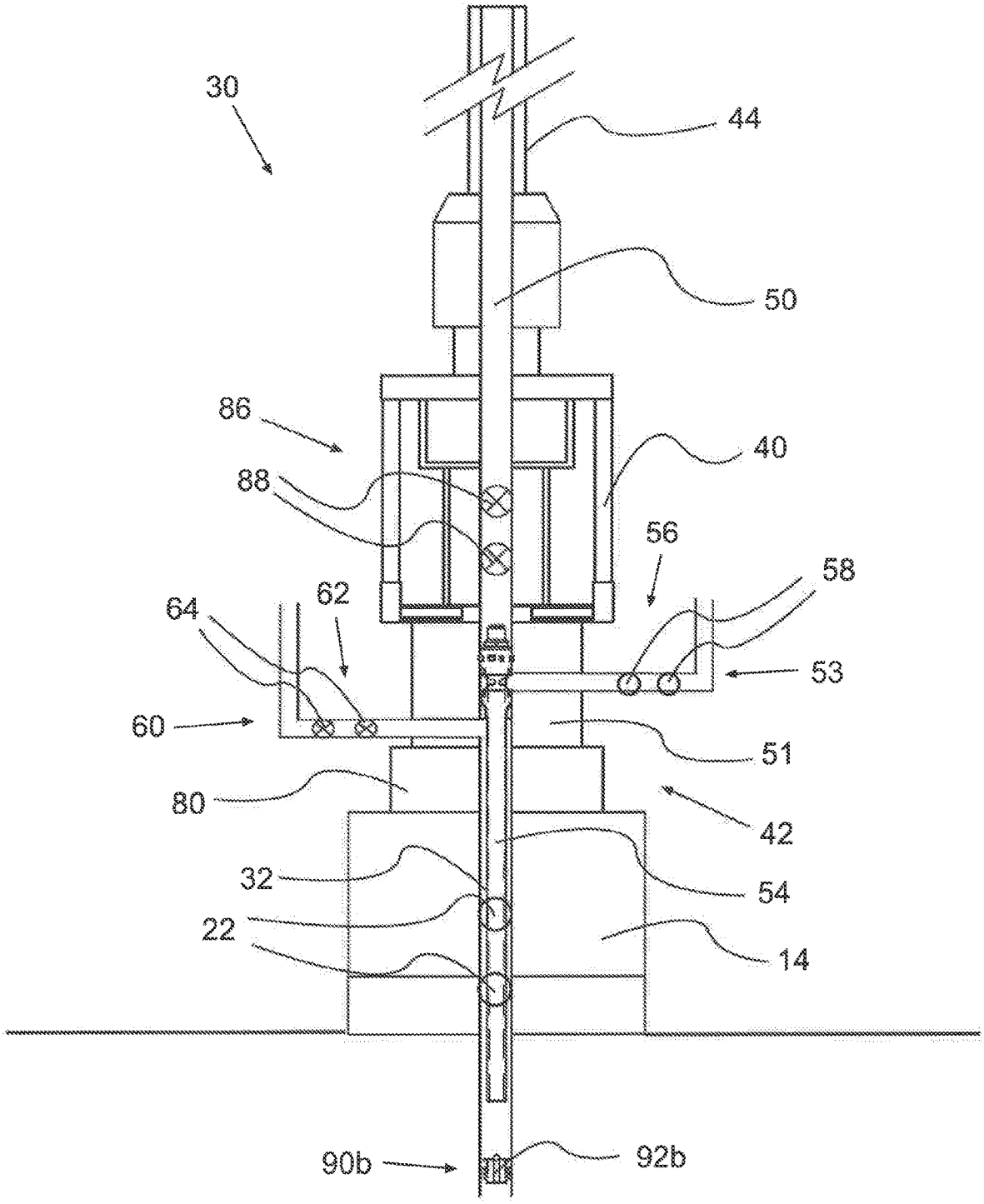
Figure 4E:
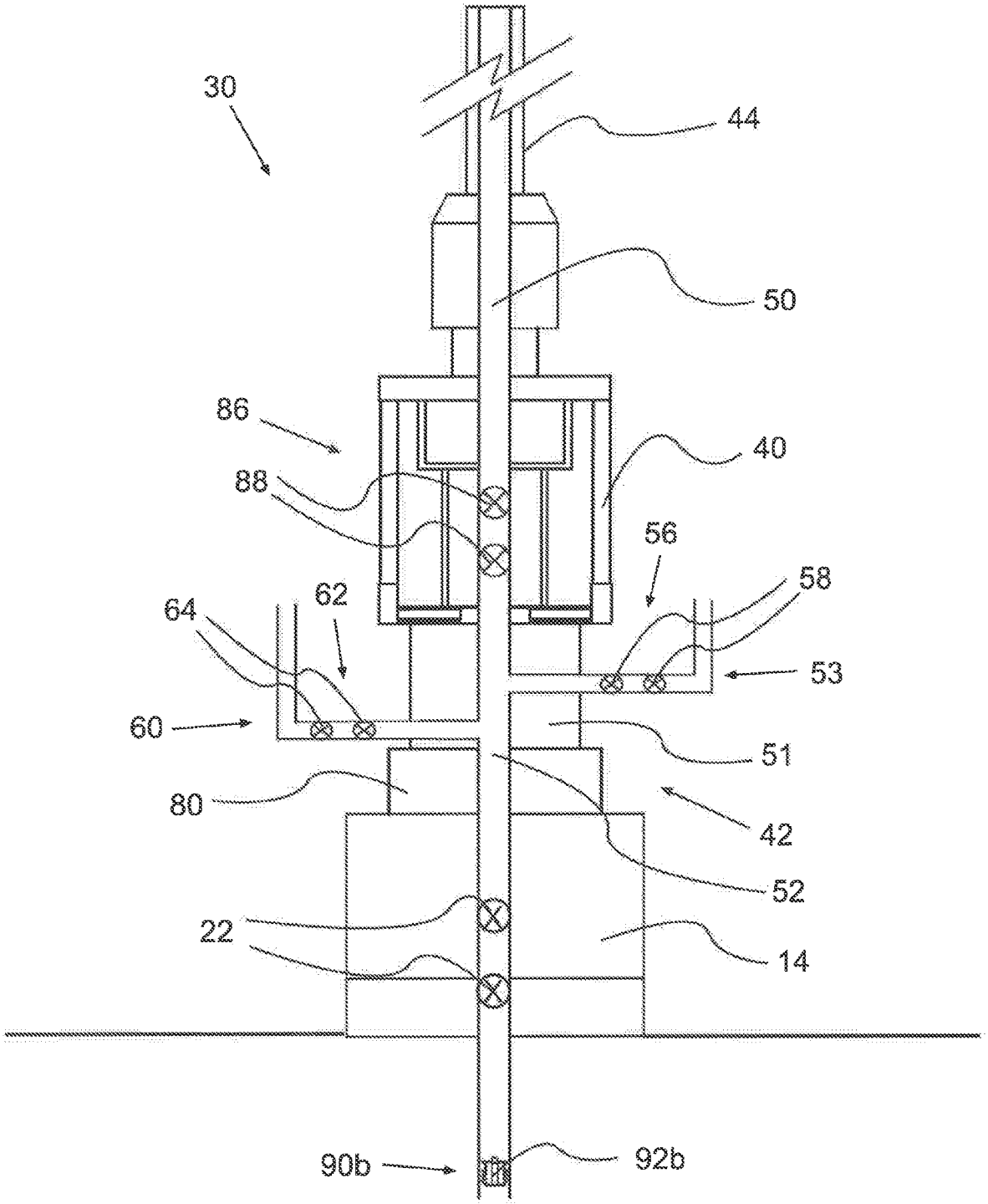
Figure 5:
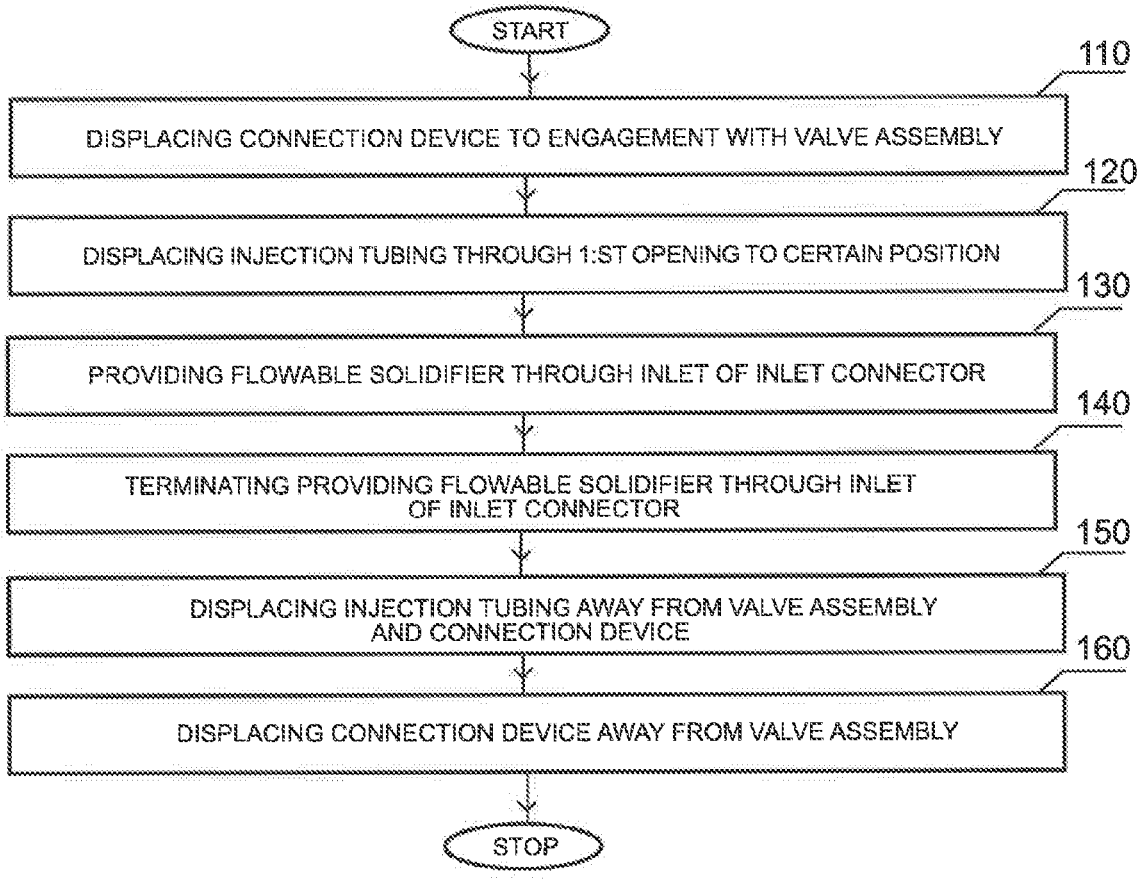

FIG. 4*e* discloses a state where the operation of providing the flowable solidifier has been terminated and the injection tubing 32 has been displaced away from the valve assembly 14 and the connection device 30. The injection tubing 32 has been displaced through the first through opening 50 of the lubricator device 44. The valves 56, 64, 88 of the connection device 30 are closed. That is, valves 64 of the well control unit 40 are closed, valves 58, 64 of the inlet 53 and the outlet 60 of the inlet connector 42 are closed. Also the valve 22 of the valve assembly 14 is closed.

The method comprises, in a step 160, displacing the connection device 30 away from the valve assembly 14.

Figure 6:
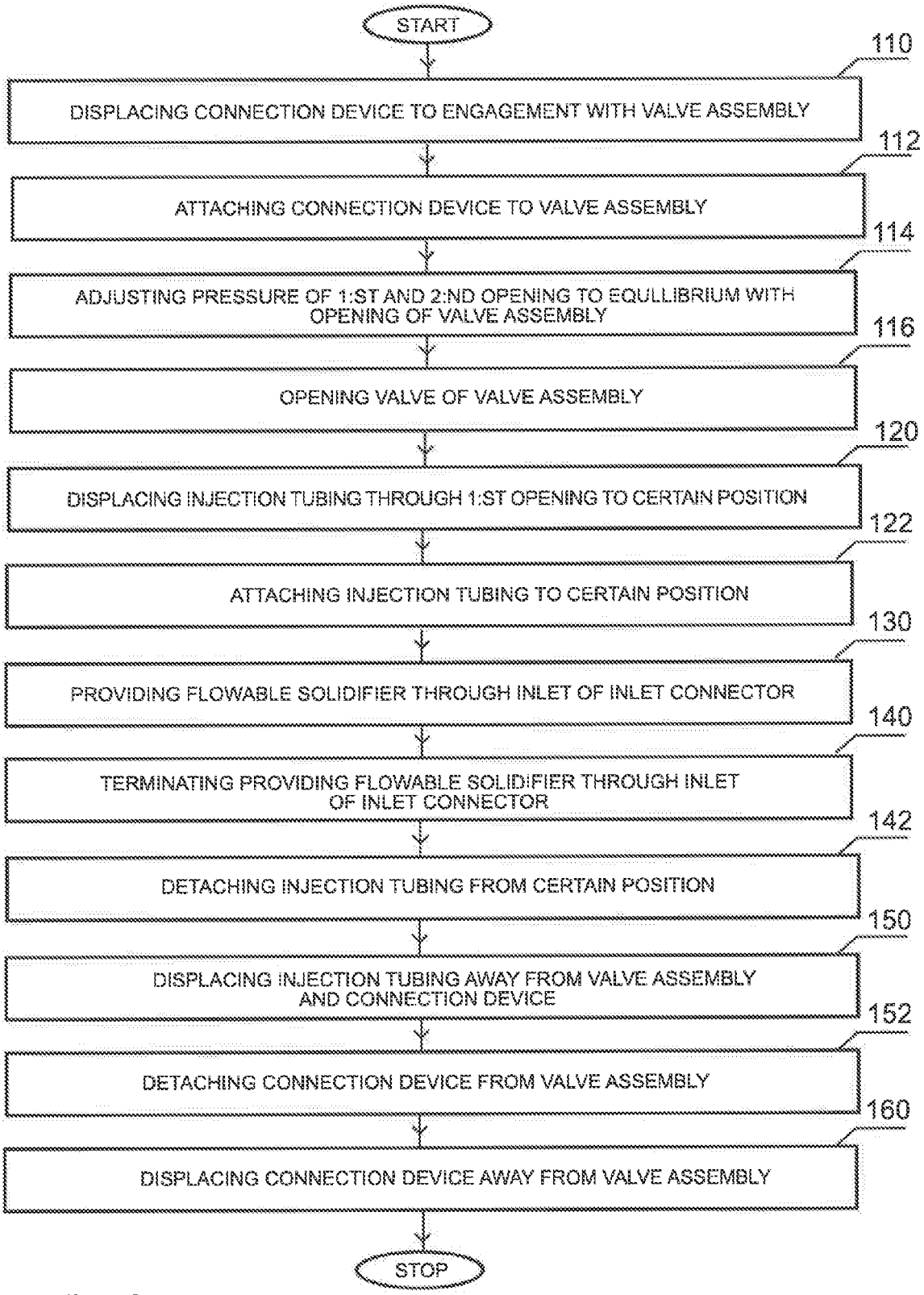
FIG. 6 discloses a flow chart of a method for providing a flowable solidifier into a subsea hydrocarbon well according to a further embodiment of the invention.

In FIG. 6 flow chart of a further method for providing a flowable solidifier into a subsea hydrocarbon well 5 according to an embodiment of the invention is disclosed.

The method differs from the embodiment in FIG. 5 in that the method comprises, in a step 112, attaching the connection device 30 to the valve assembly 14 by means of changing the attachment device 80 from a disengaged state to an engaged state. By means of the attachment arrangement 80, the connection device 30 is attached firmly to the valve assembly 14 so the that the first through opening 50 and the second through opening 52 are aligned with the opening 15 of the valve assembly 14 to the well bore 16 of the well 5.

The method further comprises, in a step 114, adjusting the pressure of the first through opening 50 of the lubricator device 44 and second through opening 52 of the inlet connector 42 so that the pressure is adjusted to equilibrium with the pressure of the opening 15 of the valve assembly 14 to the well bore 16 of the well 5.

The method further comprises, in a step 116, opening the valve 22 of the valve assembly 14 so that an open connection is established between the opening 15 of the valve assembly 14 and the first through opening 50 and the second through opening 52. Thereby, the injection tubing 32 can be safely displaced to the certain position enabling it to receive the flowable solidifier from the inlet 53 of the inlet connector 42.

The step 120 further comprises arranging the injection tubing 32 in the certain position by displacing the injection tubing 32 so that the primary stop member 74*a* of the injection tubing 32 engages with the secondary stop member 74*b* of the inlet connector 42.

In a step 122, the method comprises attaching the injection tubing 32 to the inlet connector 42 by means of changing the further attachment device 82 from a disengaged state to an engaged state.

In a step 142, the method comprises detaching the injection tubing 32 from the inlet connector 42 by means of changing the further attachment device 82 from an engaged state to a disengaged state.

In a step 152, the method comprises detaching the connection device 30 from the valve assembly 14 by means of changing the attachment device 80 from an engaged state to a disengaged state.

Figure 7:
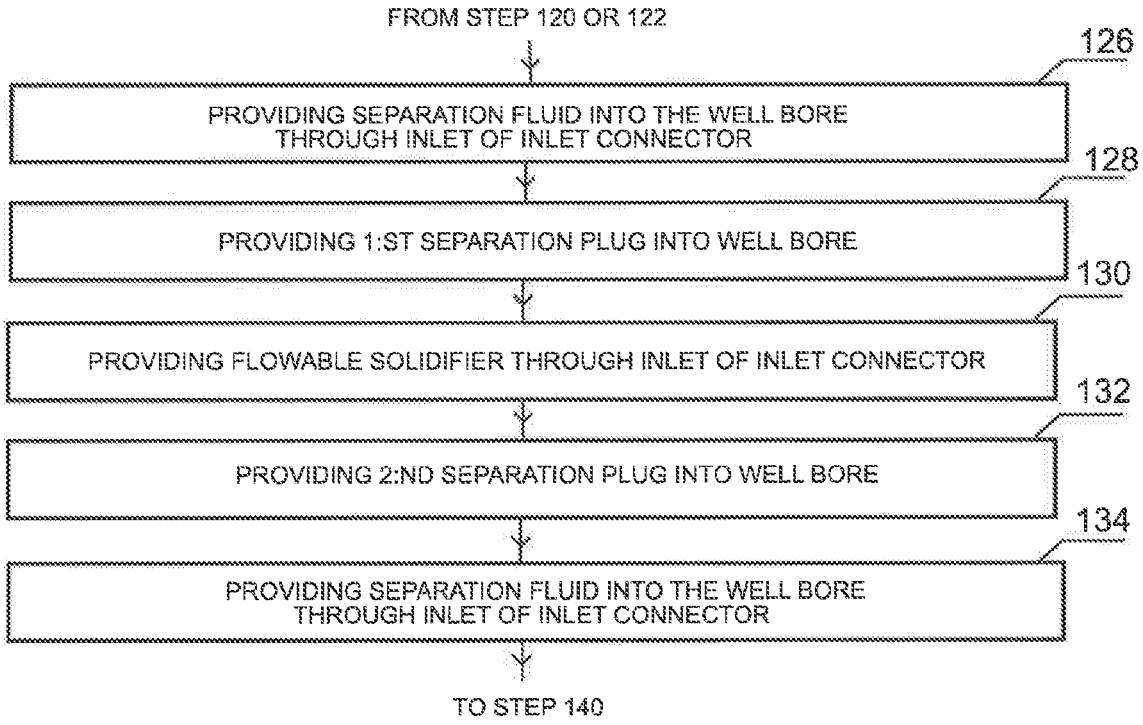
FIG. 7 discloses a flow chart of detailed steps of providing a flowable solidifier into a subsea hydrocarbon well according to a further embodiment of the invention.

In FIG. 7 is a flow chart of detailed steps of providing the flowable solidifier into a sub-sea hydrocarbon well 5 according to a further embodiment of the invention disclosed. The steps relates to detailed steps to be inserted in the embodiment in any of FIGS. 5 and 6.

The method comprises, in a step 126, providing a separation fluid through the inlet 53 of the inlet connector 42 and the third through opening 54 and into the well bore 16 of the well 5.

The method comprises, in a step 126, providing the first separation device 90*a* into the well bore 16 of the well 5. In FIG. 4*c*, the first separation plug 92*a* is being displaced into the well bore 16 while the second separation plug 92*b* remains at the end portion of the injection tubing 32. The method comprises, in a step 130, providing the flowable solidifier through the inlet 53 of the inlet connector 42 and the third through opening 54 and into the well bore 16 of the well 5, which is also illustrated by FIG. 4*c*.

The method comprises, in a step 132, providing the second separation device 90*b* into the well bore 16 of the well 5. In FIG. 4*d*, also the second separation plug 90*b* is being displaced into the well bore 16 of the well 5. The method comprises, in a step 134, providing a separation fluid through the inlet 53 of the inlet connector 42 and the third through opening 54 and into the well bore 16 of the well 5, which is also illustrated by FIG. 4*d*. The providing of the separation fluid continues until the first separation plug 92*a* and the second separation plug 92*b* have been displaced to a certain distance from the valve assembly 14. Accordingly, the flowable solidifier that is to form the barrier 20 has also been displaced to certain distance from the valve assembly 14.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. An arrangement for providing a flowable solidifier into a subsea hydrocarbon well comprising a valve assembly with an opening to a well bore, wherein the arrangement comprises:

a connection device comprising i) a well control unit comprising a lubricator device with a first through opening, ii) an inlet connector comprising a body attached to the well control unit, a second through opening in connection with the first through opening of the lubricator device, and an inlet for the flowable solidifier to the second through opening, the inlet extending from an outside of the body to the second through opening other than the through the first through opening;

wherein the connection device is adapted to be connected to the valve assembly so that the second through opening of the inlet connector is in connection with the opening of the valve assembly to the well bore of the well;

an elongated injection tubing comprising a third through opening, the injection tubing being adapted to be displaced through the lubricator device to a certain position within the second through opening, the certain position enabling the third through opening to receive the flowable solidifier from the inlet of the inlet connector and the elongated injection tubing extending into the opening of the valve assembly so that one or more valves of the valve assembly are shielded from interaction with the flowable solidifier.

2. The arrangement according to claim 1, wherein the elongated injection tubing has a length that enables it, when in said certain position, to extend into the opening of the valve assembly passing said one or more valves.

3. The arrangement according to claim 1, wherein the elongated injection tubing has a length equal to or exceeding a length of the opening of the valve assembly to the well bore.

4. The arrangement according to claim 1, wherein the connection device further comprises an attachment device for providing a releasable attachment of the connection device to the valve assembly of the well so that the second through opening of the inlet connector is firmly connected to the opening of the valve assembly.

5. The arrangement according to claim 1, wherein the injection tubing comprises a primary stop member and the inlet connector comprises a secondary stop member, and wherein the injection tubing is adapted to be displaced to a position in which the primary stop member and secondary stop member engage with each other in the certain position.

6. The arrangement according to claim 1, wherein the arrangement comprises a further attachment device adapted to provide a releasable attachment of the injection tubing to the inlet connector so that the injection tubing is firmly attached in said certain position.

7. The arrangement according to claim 1, wherein the well control unit comprises a lubricator valve assembly comprising a lubricator valve device adapted to be controlled so that the pressure of the first through opening of the lubricator device and second through opening of the inlet connector are adjusted to equilibrium with the pressure of the opening of the valve assembly to the well bore of the well.

8. The arrangement according to claim 1, wherein the arrangement comprises attachment means for wireline connection to the connection device.

9. The arrangement according to claim 1, wherein the arrangement comprises further attachment means for wireline connection to the injection tubing.

10. The arrangement according to claim 1, wherein the connection device further comprises an outlet for discharge of a fluid from the well bore.

11. The arrangement according to claim 1, wherein the inlet connector comprises connection means for supply of the flowable solidifier to the inlet.

12. The arrangement according to claim 1, wherein the arrangement further comprises a first separation device and a second separation device adapted to be introduced into the well bore and having the flowable solidifier between them.

13. The arrangement according to claim 12, wherein the first separation device comprises a first separation plug and a first displacement element adapted to engage with the first separation plug, and wherein the second separation device comprises a second separation plug and a second displacement element adapted to engage with the second separation plug.

14. The arrangement according to claim 13, wherein the first separation plug and second separation plug are positioned at an end portion of the injection tubing in connection with the third through opening, and wherein the inlet of the inlet connector and the third through opening of the injection tubing are configured dimensioned for allowing a passage of the first displacement element and the second displacement element.

15. The arrangement according to claim 1, wherein the inlet of the inlet connector and the third through opening of the injection tubing are configured for a passage of the flowable solidifier, which flowable solidifier comprises a flowable configuration comprising cement adapted to solidify and form a concrete barrier in the well bore of the well.

16. The arrangement according to claim 1, wherein the arrangement further comprises a seal arrangement adapted to form a sealing between the inlet connector and the injection tubing when the injection tubing is in said certain position.

17. A system for providing a flowable solidifier into a subsea hydrocarbon well, wherein the system comprises an arrangement comprising a valve assembly with an opening to a well bore, wherein the arrangement comprises:

a connection device comprising i) a well control unit comprising a lubricator device with a first through opening, ii) an inlet connector comprising a body attached to the well control unit, a second through opening in connection with the first through opening of the lubricator device, and an inlet for the flowable solidifier to the second through opening, the inlet extending from an outside of the body to the second through opening other than the through the first through opening;

wherein the connection device is adapted to be connected to the valve assembly so that the second through opening of the inlet connector is in connection with the opening of the valve assembly to the well bore of the well;

wherein the arrangement further comprises an elongated injection tubing comprising a third through opening, the injection tubing being adapted to be displaced through the lubricator device to a certain position within the second through opening, the certain position enabling the third through opening to receive the flowable solidifier from the inlet of the inlet connector and the elongated injection tubing extending into the opening of the valve assembly so that one or more valves of the valve assembly are shielded from interaction with the flowable solidifier; and a lifting arrangement for lifting the well control unit and the elongated injection tubing to the valve assembly of the well.

18. A method for providing a flowable solidifier into a subsea hydrocarbon well comprising a valve assembly with an opening to a well bore, wherein the method comprises:

providing a connection device comprising:

i) a well control unit comprising a lubricator device with a first through opening; and ii) an inlet connector comprising a body attached to the well control unit, a second through opening in connection with the first through opening of the lubricator device, and an inlet for the flowable solidifier to the second through opening, the inlet extending from an outside of the body to the second through opening other than the through the first through opening;

displacing the connection device to engagement with the valve assembly of the well so that the second through opening of the inlet connector is brought in connection with the opening of the valve assembly;

displacing an elongated injection tubing comprising a third through opening through the lubricator device to a certain position within the second through opening, the certain position enabling the third through opening of the elongated injection tubing to receive the flowable solidifier from the inlet of the inlet connector and so that the elongated injection tubing extends into the opening of the valve assembly passing one or more valves of the valve assembly; and providing the flowable solidifier through the inlet of the inlet connector and the third through opening, and into the well bore of the well.

19. The method according to claim 18, wherein the method further comprises:

terminating providing the flowable solidifier to the through the inlet of the inlet connector;

displacing the connection device away from the valve assembly and the connection device, and displacing the connection device away from the valve assembly.

20. The method according to claim 18, wherein the method further comprises:

attaching the connection device to the valve assembly by means of changing the attachment device from a disengaged state to an engaged state.

21. The method according to claim 18, wherein the method further comprises:

arranging the injection tubing to said certain position by displacing the injection tubing so that the primary stop member of the injection tubing engages with the secondary stop member of the inlet connector.

22. The method according to claim 18, wherein the method further comprises:

attaching the injection tubing to the inlet connector by means of changing the further attachment device from a disengaged state to an engaged state.

23. The method according to claim 18, wherein the method further comprises:

before displacing the injection tubing through the lubricator device, adjusting the pressure of the first through opening of the lubricator device and second through opening of the inlet connector so that the pressure is adjusted to equilibrium with the pressure of the opening of the valve assembly to the well bore of the well, and opening a valve of the valve assembly so that an open connection is established between the opening of the valve assembly and the first through opening and the second through opening.

24. The method according to claim 18, wherein the method further comprises:

before displacing the connection device away from the valve assembly, closing a valve of the valve assembly so that the opening into the well bore of the well is closed.

25. The method according to claim 18, wherein the method further comprises:

after closing the valve of the valve assembly, displacing the injection tubing out from the connection device through the lubricator device, and displacing the connection device away from the valve assembly.

26. The method according to claim 18, wherein the method further comprises before displacing the injection tubing out from the connection device, detaching the injection tubing from the inlet connector by means of changing the further attachment device from an engaged state to a disengaged state.

27. The method according to claim 18, wherein the method further comprises before displacing the connection device away from the valve assembly, detaching the connection device from the valve assembly by means of changing the attachment device from an engaged state to a disengaged state.

28. The method according to claim 18, wherein the step of providing the flowable solidifier further comprises the steps of:

a) providing a separation fluid through the inlet of the inlet connector and the third through opening into the well bore of the well, b) providing the first separation device into the well bore of the well, c) providing a flowable solidifier through the inlet of the inlet connector and the third through opening into the well bore of the well, d) providing the second separation device into the well bore of the well, and e) providing a separation fluid through the inlet of the inlet connector and the third through opening into the well bore of the well.

* * * * *